US011158298B1

(12) United States Patent
Sutherland, Jr.

(10) Patent No.: US 11,158,298 B1
(45) Date of Patent: Oct. 26, 2021

(54) WALL-MOUNTED ACOUSTIC DEADENING

(71) Applicant: De-Fi Systems, LLC, Pasadena, CA (US)

(72) Inventor: James Sutherland, Jr., Palm Desert, CA (US)

(73) Assignee: De-Fi Systems, LLC, Pasadena, CA (US)

( * ) Notice: Subject to any disclaimer, the term of this patent is extended or adjusted under 35 U.S.C. 154(b) by 0 days.

(21) Appl. No.: 17/369,418

(22) Filed: Jul. 7, 2021

(51) Int. Cl.
*G10K 11/00* (2006.01)

(52) U.S. Cl.
CPC ..... *G10K 11/002* (2013.01)

(58) Field of Classification Search
None
See application file for complete search history.

(56) References Cited

U.S. PATENT DOCUMENTS 7,063,184 B1 * 6/2006 Johnson ..... E04B 1/86 181/210

* cited by examiner

*Primary Examiner* — Kenny H Truong
(74) *Attorney, Agent, or Firm* — Socal IP Law Group LLP; Nikki M. Dossman; Jonathan Pearce

(57) ABSTRACT

A wall-mounted acoustic deadening device includes a mounting device including a mounting plate and a mounting peg extending from the mounting plate and having a first portion adjacent the mounting plate with a first diameter and a second portion opposite the mounting plate having a second diameter smaller than the first diameter. The device also includes at least two panels, each panel including a plurality of panel holes. A panel hole diameter is less than the first diameter and greater than or equal to the second diameter. A first panel is configured to be attached to the mounting device via the mounting peg extending through one of the plurality of panel holes. A second panel is configured to be attached to the mounting device adjacent to the first panel via the mounting peg extending through the one of the plurality of panel holes.

20 Claims, 9 Drawing Sheets

© 2021 De-Fi Systems, LLC

© 2021 De-Fi Systems, LLC

© 2021 De-Fi Systems, LLC

© 2021 De-Fi Systems, LLC

© 2021 De-Fi Systems, LLC

© 2021 De-Fi Systems, LLC

© 2021 De-Fi Systems, LLC

© 2021 De-Fi Systems, LLC

© 2021 De-Fi Systems, LLC

© 2021 De-Fi Systems, LLC

WALL-MOUNTED ACOUSTIC DEADENING

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to acoustic deadening, and, more particularly, to wall-mounted acoustic deadening.

Description of the Related Art

Acoustic deadening panels are sound absorbing panels placed in a room, e.g., on walls or ceilings, to control and reduce unwanted sound, such as echoes and ambient noise, for various situations like during sound or video recordings or streaming. Further, acoustic deadening panels can reduce or prevent the transfer of sound out of or into a room, e.g., to provide privacy or avoid disturbing others. The properties of sound in a room can also be enhanced by improving sound quality with acoustic deadening panels. Applications can include recording studios, churches, home theaters, restaurants, and libraries. The purpose of the acoustic deadening panels is to reduce, but not entirely eliminate, resonance within the room.

As the prevalence of audio recording and streaming applications increase, there is a need for acoustic deadening panels that are easy to transport and install, and economical to purchase.

Throughout this description, elements appearing in figures are assigned three-digit reference designators, where the two least significant digits are specific to the element and the one or two most significant digit is the figure number where the element is first introduced. An element that is not described in conjunction with a figure may be presumed to have the same characteristics and function as a previously described element having the same reference designator.

DETAILED DESCRIPTION

Description of Apparatus

Figure 1:
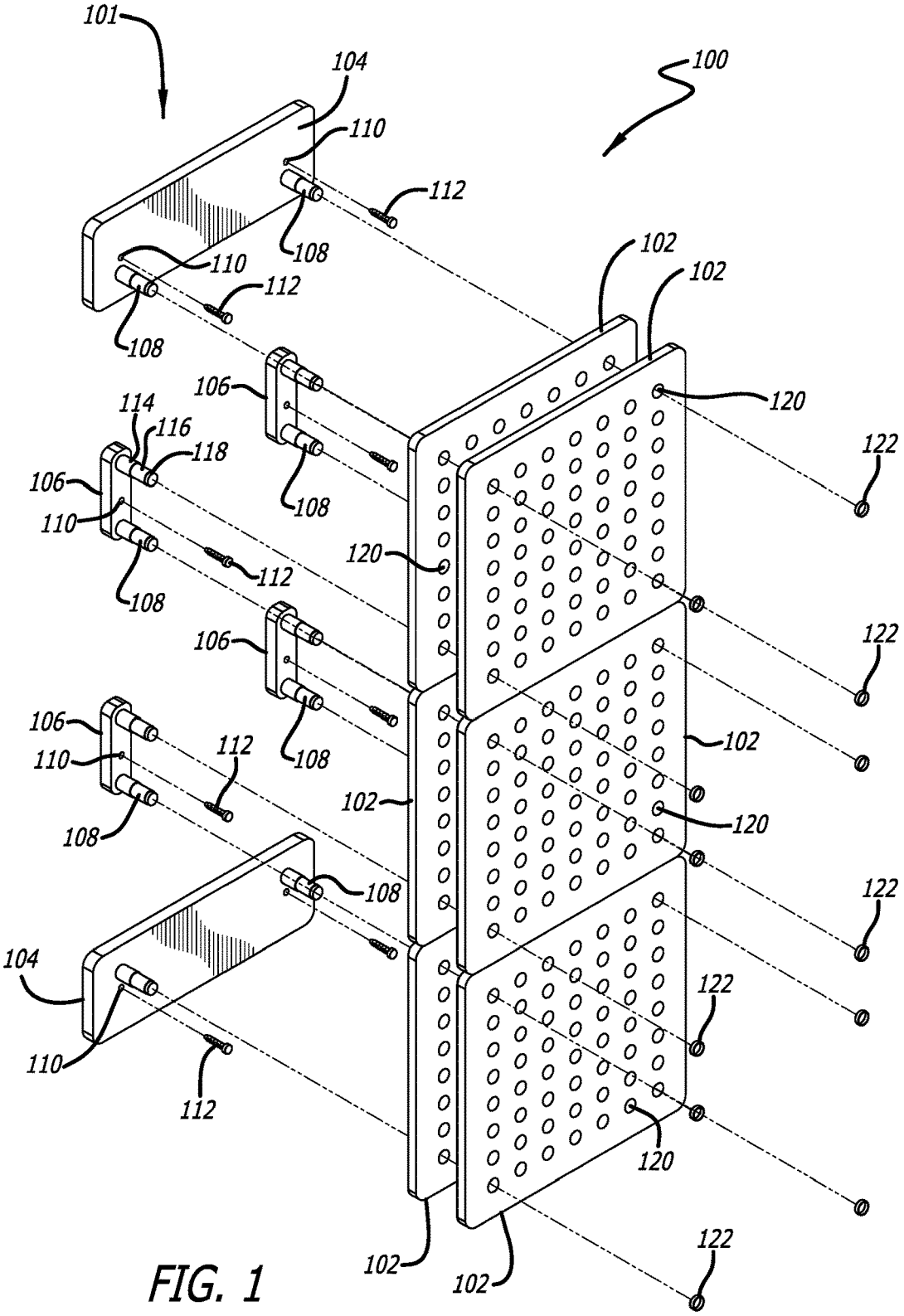
FIG. 1 shows an exploded perspective view of a wall-mounted acoustic deadening device.
Figure 2:
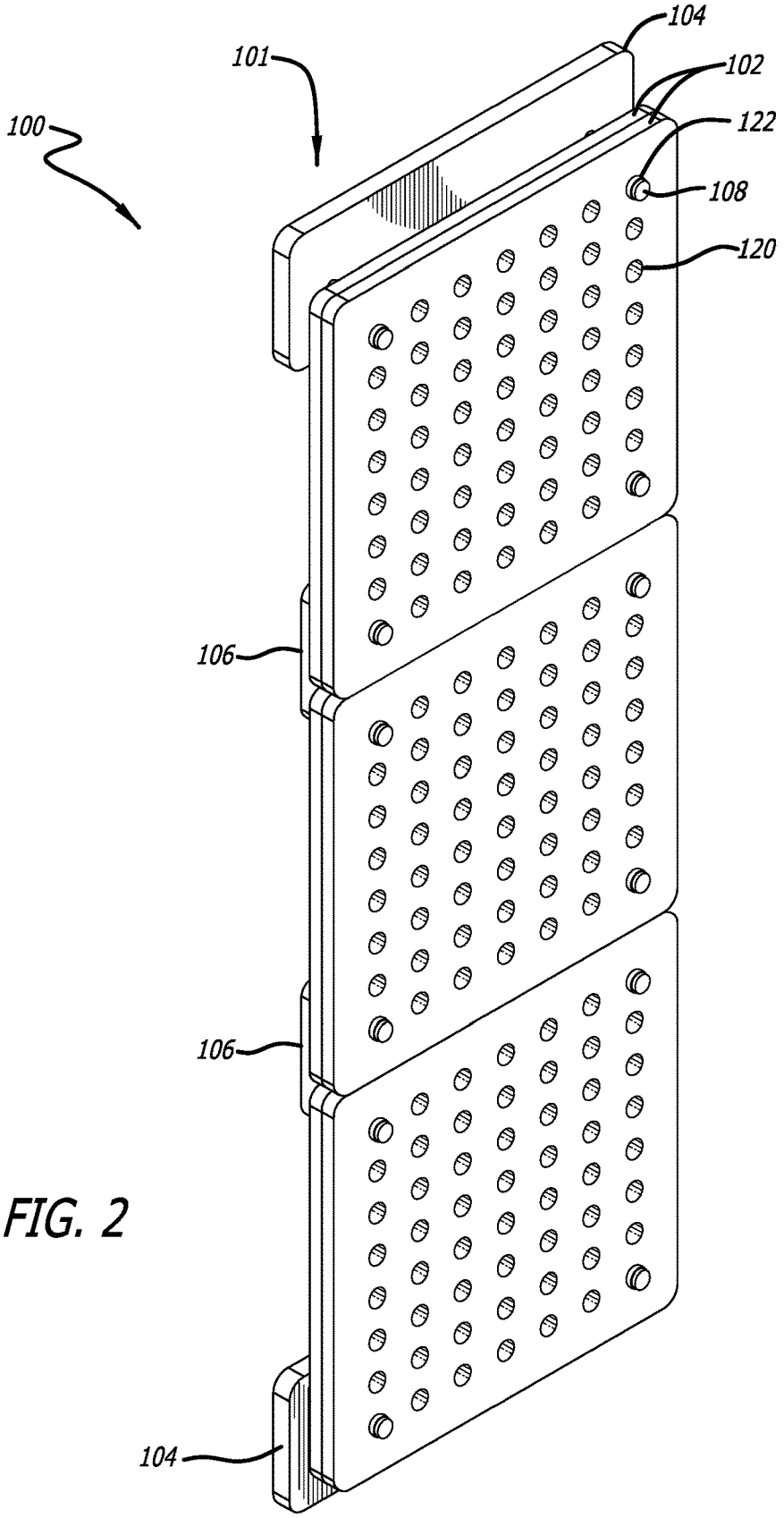
FIG. 2 shows a front perspective view of the wall-mounted acoustic deadening device of FIG. 1.
Figure 3:
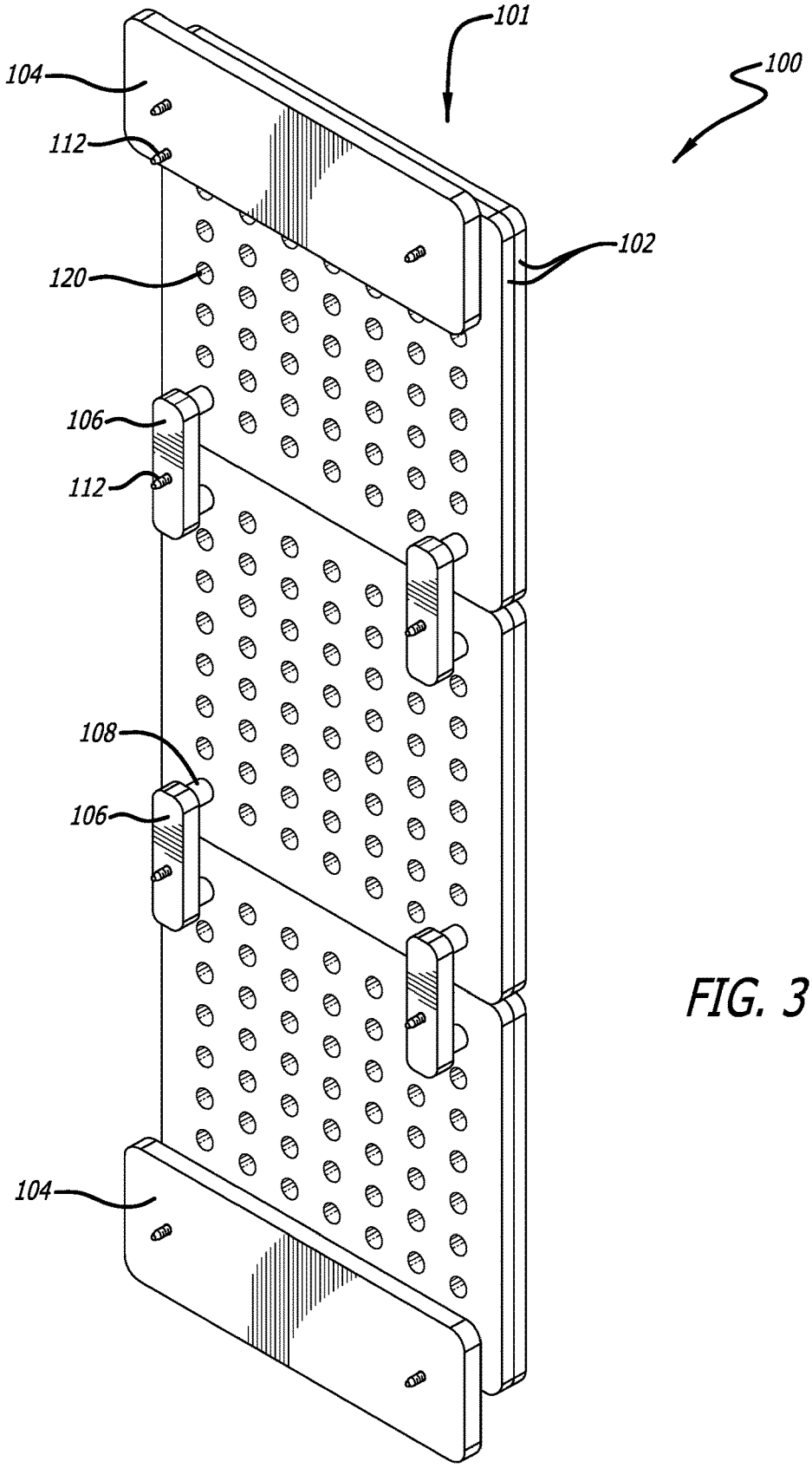
FIG. 3 shows a back perspective view of the wall-mounted acoustic deadening device of FIG. 1.
Figure 4:
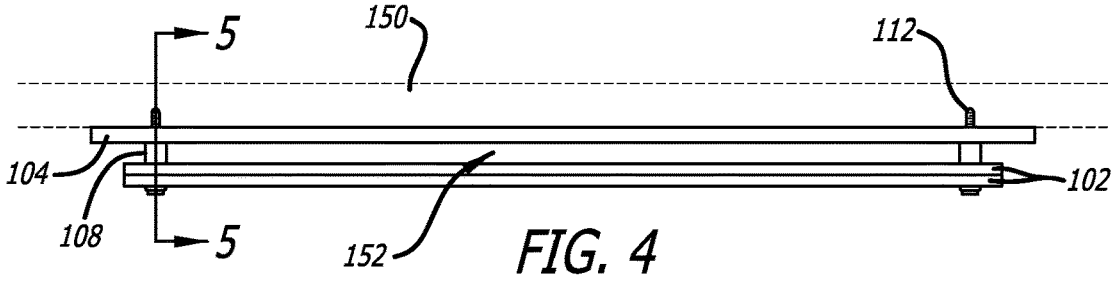
FIG. 4 is a top view of the wall-mounted acoustic deadening device of FIG. 1.
Figure 5:
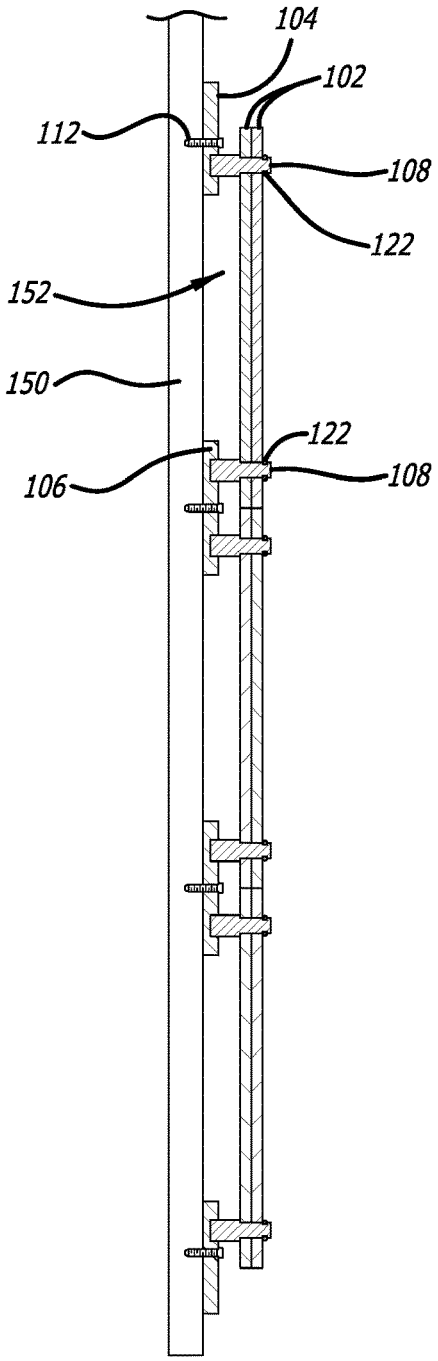
FIG. 5 is a cross-sectional view through plane 5 of FIG. 4 of the wall-mounted acoustic deadening device of FIG. 1.

FIGS. 1-5 show a wall-mounted acoustic deadening device 100. The acoustic deadening device 100 includes panels 102 that are mounted to a wall 150 via a mounting device 101. The acoustic deadening device 100 absorbs sound waves from a room in which it is mounted, which can improve the audio quality of voice and video streaming and recording and live audio performances. The acoustic deadening device 100 can also improve audio privacy and reduce unwanted noise pollution. The configuration of the panels 102 and the mounting device 104 make the audio deadening device 100 easy to transport and assemble and cost-effective to manufacture.

The panels 102 have a flattened cuboid-like shape with square faces that are configured to be planar to a wall when mounted on the mounting device. The square faces have rounded corners primarily for aesthetic reasons. A dimension of the square face may be in a range from 9 inches to 48 inches. A thickness of the panel can be in a range from 9 mm to 48 mm. However, the panels may have any suitable shape. For example, the faces of the panels can have a rectangular shape or a curved shape. The corners and edges can be more or less rounded and/or beveled. The thickness of the panel can be uniform or can vary across the panel. The panels may be round, rectangular, oval, trapezoidal or other shapes. The square shape has been chosen as a preferred shape because it may be broken down into smaller pieces for less-expensive shipping following manufacture for delivery. But other shapes may be suitable for performing the desired resonance-reducing functions as well.

The panels 102 can be formed of any suitable material, such as wood, foam, rubber, plastic, a composite, wool, felt, cardboard, and polyethylene terephthalate felt. Preferably, polythylene terephthalate felt is used. The material should have suitable acoustic properties, such as acoustic foam. Further, the material should be sturdy but light enough to withstand shipping and installation on a wall. The material should also be able to maintain its shape over an extended time period of being installed on a wall.

The panels 102 have round panel holes 120 that pass through a thickness of the panel 102. As shown in FIGS. 1-5, there are fifty-six panel holes arranged in eight rows of seven. However, there may be more or fewer holes, such as a number in a range of 4 to 200. Further, the panel holes can be arranged in a regular or random pattern, or in any other pattern that supports favorable results in acoustic dampening or is aesthetically pleasing. The panel holes can have a diameter in a range from 6 mm to 48 mm. While round panel holes are shown, the panel holes can have any suitable cross-sectional shape, such as a square, rectangle, triangular, a slot, or an oval. The panels holes 122 are shown extending through an entire thickness of the panel 102. However, some of the panel holes 122 may optionally only extend partially through the thickness of the panel 102. The panel holes may have different shapes and sizes from one another.

The panel holes perform the majority of the function of acoustic dampening. In particular, each hole acts as a chamber into which sound may pass and then is dampened.

Once it passes through, the resulting breakup in the acoustic waves causes the sound to "die" in the parlance. The panel holes allow for the uniform waves to be broken up sufficiently. This has been shown to be highly effective. For example, installation of 4 of the panels shown in FIG. 1 results in a reduction of approximately RT60 in 0.7 seconds when installed within a typical 100 sq. ft. recording studio space with a minimum 50 mm air gap between the panels and the wall.

The mounting device 101 includes large mounting plates 104 and small mounting plates 106. Mounting plate 104 is shown as a flattened rectangular prism shape having a rectangular face with rounded corners configured to be planar to the wall 150 when mounted. Large mounting plate 104 is shown in FIGS. 1-5 to have a length slightly longer than the panels 102 and a width about one third of the panel 102 length. For example, large mounting plate 104 can have a length in a range of about 9 inches to 48 inches and a width in a range of about 1 inches to 12 inches. The large mounting plate 104 can have a thickness in a range of about of 3 mm to 36 mm. However, large mounting plate 104 can have any suitable shape and dimensions. For example, a face of the large mounting plate can square, oval, circular, or triangular. The corners and edges of the large mounting plate 104 can be more or less rounded and/or beveled.

The mounting device 101 is designed to separate the panels from the wall so that sound may be dampened. As a result, mounting pegs (discussed below) have offsets of 50 mm. Other lengths may be used, but those offsets cause the associated panels 102 to be distanced from the wall upon which the wall-mounted acoustic deadening device 100 is mounted. That distance from the walls serves the purpose of breaking up acoustic waves to cause the desired dampening effect.

Small mounting plate 106 is shown as a flattened rectangular prism shape having a rectangular face with rounded corners configured to be planar to the wall 150 when mounted. Small mounting plate 106 is shown in FIGS. 1-5 to have a smaller length and width than large mounting plate 104. For example, small mounting plate 106 can have a length in a range of about 3 inches to 12 inches and a width in a range of about 4 inches to 5 inches. The small mounting plate can have a thickness in a range of about of 3 mm to 36 mm. However, small mounting plate 106 can have any suitable shape and dimensions. For example, a face of the mounting plate can square, oval, circular, or triangular. The corners and edges of the large mounting plate 104 can be more or less rounded and/or beveled.

Large mounting plate 104 and small mounting plate 106 can be formed of any suitable material, such as wood, a composite, plastic, or metal. The material should have suitable acoustic properties, such as wood. Further, the material should be sturdy but light enough to withstand shipping and installation on a wall. The material should also be able to maintain its shape and supported the weight of the panels 102 over an extended time period of being installed on a wall.

Large mounting plate 104 and small mounting plate 106 each have at least one fastener hole 110 extending through a thickness of the plate that is configured to receive a fastener 112, such as a screw or a nail. The fastener 112 extends through the hole to attach the mounting plates 104 and 106 to the wall 150. The fastener hole 110 can be threaded or not. Two fastener holes 110 are shown in FIGS. 1-5. However, the mounting plates 104 and 106 can have any suitable number of fastener holes 110, such as one, three, four, five, six, or more. In one example, the fastener hole 110 and fastener 112 are configured such that the device can be mounted on walls of formed of various materials, such as dry wall, brick, wood, concrete, or any other type of wall material. Alternatively, the large mounting plate 104 and the small mounting plate 106 can be mounted to the wall 150 via an adhesive or a bracket.

At least one mounting peg 108 extends perpendicularly from the large mounting plate 104 and the small mounting plate 106. The mounting peg 108 can be attached to the large mounting plate 104 and small mounting plate 106 by any suitable means, such as a screw, nail, glue, a friction fit in a hole in the mounting plates 104 and 106, or glue. In another example, the mounting peg may be formed monolithically along with the large mounting plate 104 and the small mounting plate 106. The mounting peg 108 can be formed of any suitable material, such as wood, a composite, plastic, metal or rubber. Preferably, wood is used because it is inexpensive and offers preferable acoustic properties (e.g. does not rattle or buzz when properly mounted). However, any suitable material may be used.

The mounting peg 108 can have any suitable length, e.g., a length in a range from 25 mm to 250 mm. The mounting peg 108 can have a first diameter, e.g., in a range 3 mm to 150 mm, for a first portion 114 of the mounting peg 108 adjacent to the large mounting plate 104 and small mounting plate 106. The mounting peg 108 can have a second diameter, e.g., in a range 2 mm to 149 mm, for a second portion 116 of the mounting peg 108 opposite the large mounting plate 104 and small mounting plate 106, where the second diameter is smaller than the first diameter. Optionally, the mounting peg 108 can have a third diameter, e.g., in a range 1 mm to 148 mm, at a tip 118 of the mounting peg 108 away from the mounting plate 104, 106, where the third diameter is smaller than the second diameter.

The first diameter is sized to be larger than panel hole 120, and the second diameter is sized to be smaller than the panel hole 120. Thus, a first panel 102 can be mounted on the mounting peg 108 by sliding one of the panel holes 120 onto the second portion 116. Because the panel hole 120 is smaller than the first portion 114, the panel 102 will not slide onto the first portion 114. Thus, the panel 102 will be positioned away from the large mounting plate 104 and the small mounting plate 106, and there will be an open space 152 between the panel 102 and the wall 150. The open space 152 will deter sound waves from passing through the wall 152, because of the air gap and quarter wavelength rule.

A second panel 102 can be mounted on the mounting peg 108 adjacent and planar to the first panel 102 by sliding one of the panel holes 120 of the second panel onto the second portion 116 of the mounting peg. The first and second panels are shown abutted in FIGS. 1-5. Alternatively, the panels can be spaced apart with an open space between them.

The panels 102 can be fixed to the mounting peg 108 by positioning a gasket 122 about a tip of the mounting peg 108. The gasket 122 can be any suitable material, such as rubber, plastics, or vinyl. The gasket 122 is sized to securely fit about the tip of the mounting peg 108 distal to the mounted panel 102. The gasket 122 may be positioned about the second portion 116 of the mounting peg 108. Alternatively, a tip of the mounting peg 108 can have a third portion with a third diameter less than the second diameter. In one example, the third portion can have or be a groove circumscribing the tip of the mounting peg 108 sized to receive the gasket 122 to deter the gasket 122 from being pushed off the mounting peg 108. In another example, the panels 102 are fixed to the mounting peg with a friction fit. The panels 102 may be fixed to the mounting peg 108 via any other suitable means, such as a pin, a screw, or an adhesive.

While the mounting pegs 108 are shown to have a circular cross-sectional shape, the mounting pegs 108 can have any suitable cross-sectional shape, such as square, triangular, rectangular, or oval. The mounting pegs 108 can have a cross-sectional shape that corresponds to the cross-sectional shape of the panel holes 122 or a shape that does not correspond. Different portions of the mounting pegs 108 can have same or different cross-sectional shapes. For example, the first portion 112 can have a square cross-sectional shape and the second portion 114 can have circular cross-sectional shape.

As shown in FIGS. 1-5, six panels 102 are mounted in the wall-mounted acoustic deadening device 100. The directions described below (i.e., top, middle, bottom) are with respect to the figures as shown and described orientation as the device 100 would be mounted on the wall. At the top of the device 100, two panels 102 (e.g., a first and second panel) are mounted abutted to each other via a larger mounting plate 104, where one mounting peg 108 of the large mounting plate 104 extends through a top corner panel hole 120 of each of the panels 108 and the other mounting peg 108 of the large mounting plate 104 extends through the other top corner panel hole 120 of each of the panels 102. Similarly at the bottom of the device 100, two other panels 102 (e.g., a third and fourth panel) are mounted abutted to each other via a large mounting plate 104, where one mounting peg 108 of the large mounting plate 104 extends through a bottom corner panel hole 120 of each of the panels 108 and the other mounting peg 108 of the large mounting plate 104 extends through the other bottom corner panel hole 120 of each of the panels 102.

The two middle panels 102 (e.g., a fifth and six panel) of the six panels are mounted abutted to each other between the top panels and the bottom panels via the small mounting plates 106. The middle panels 102 are coupled to the top panels 102. One mounting peg 108 of a first small mounting plate 106 extends through top corner panel holes 120 of the middle panels 102 and the other mounting peg 108 of the first small mounting plate 106 extends through bottom corner panel holes 120 of the top panels 102. One mounting peg 108 of a second small mounting plate 106 extends through the other top corner panel holes 120 of the middle panels 108 and the other mounting peg 108 of the second small mounting plate 106 extends through the other bottom corner panel holes 120 of the top panels 102.

Similarly, the middled panels 102 are coupled to the bottom panels 102. One mounting peg 108 of a third small mounting plate 106 extends through a bottom corner panel hole 120 of the middle panels 108 and the other mounting peg 108 of the third small mounting plate 106 extends through a top corner panel hole 120 of the bottom panels 102. One mounting peg 108 of a fourth small mounting plate 106 extends through the other bottom corner panel hole 120 of the middle panels 108 and the other mounting peg 108 of the fourth small mounting plate 106 extends through the other top corner panel hole 120 of the top panels 102.

Thus, the configuration of the six panels 102 in the device of FIGS. 1-5 is three vertically stacked pairs of panels 102. The pairs of panels 102 are joined together by the small mounting plates 106, which also mount the panels 102 to the wall 150. The top and bottom of the device 100 are mounted to the wall 104 by the large mounting plates 104.

To mount the device 100 to the wall 150, the large mounting panels 104 and the small mounting panels 106 are mounted to the wall 150 via fastening devices 112 (e.g., a screw or a nail) through the fastener holes 110. Both the large mounting panels 104 and the small mounting panels 106 are mounted on the wall 150 with a suitable orientation with respect to each other such that all of the mounting pegs 108 of each are positioned to engage panel holes 120 of the panels 108. In one example a template can be used to suitably position the fastening devices 112 and large mounting panels 104 and small mounting panels 106.

The panels 108 are then mounted on and fixed to the mounting pegs 108. The panels 108 can optionally be fixed to the mounting pegs 108 by positioning the gaskets 122 about the tips of the mounting pegs 108, where the gaskets 122 may or may not be seated in grooves.

While FIGS. 1-5 shows three vertically stacked pairs of panels, the device 100 is modular and any other suitable number and configuration of panels can be used. For example, other numbers of pairs of panels can be used, such as two, four, five, six, eight, ten, or more. The pairs of panels can be configured in one or more vertical columns or one or more horizontal rows. While pairs of panels are shown mounted on a mounting peg together, a single panel can be mounted on a mounting peg or a greater number of panels, such as three, four or five panels can be mounted together on a mounting peg. Any appropriate number of large mounting plates and small mounting plates can be utilized to mount the panels to the wall.

While the mounting pegs are shown engaging panel holes at the corner of the panels, the mounting pegs need not necessarily engage only corner panels holes and can engage any of the panel holes for mounting the panels. Therefore, the mounting plates and panels can be configured in a suitable and convenient manner for various different applications. For example, the mounting plates and panels can be configured to accommodate doors, windows, electrical sockets and switches, other wall obstructions and irregularities, and walls of various heights and widths.

Figure 6:
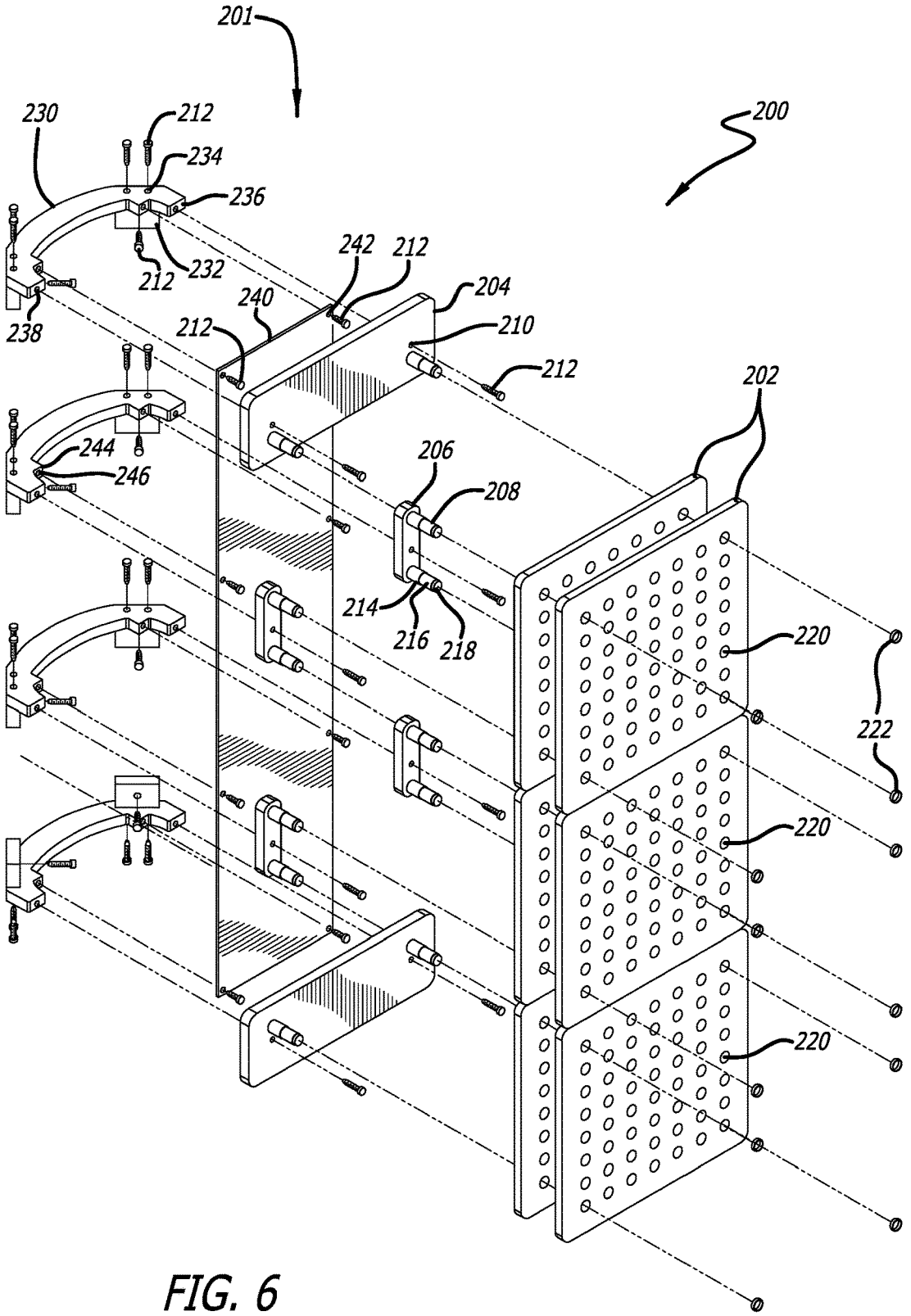
FIG. 6 shows an exploded perspective view of a corner wall-mounted acoustic deadening device.
Figure 7:
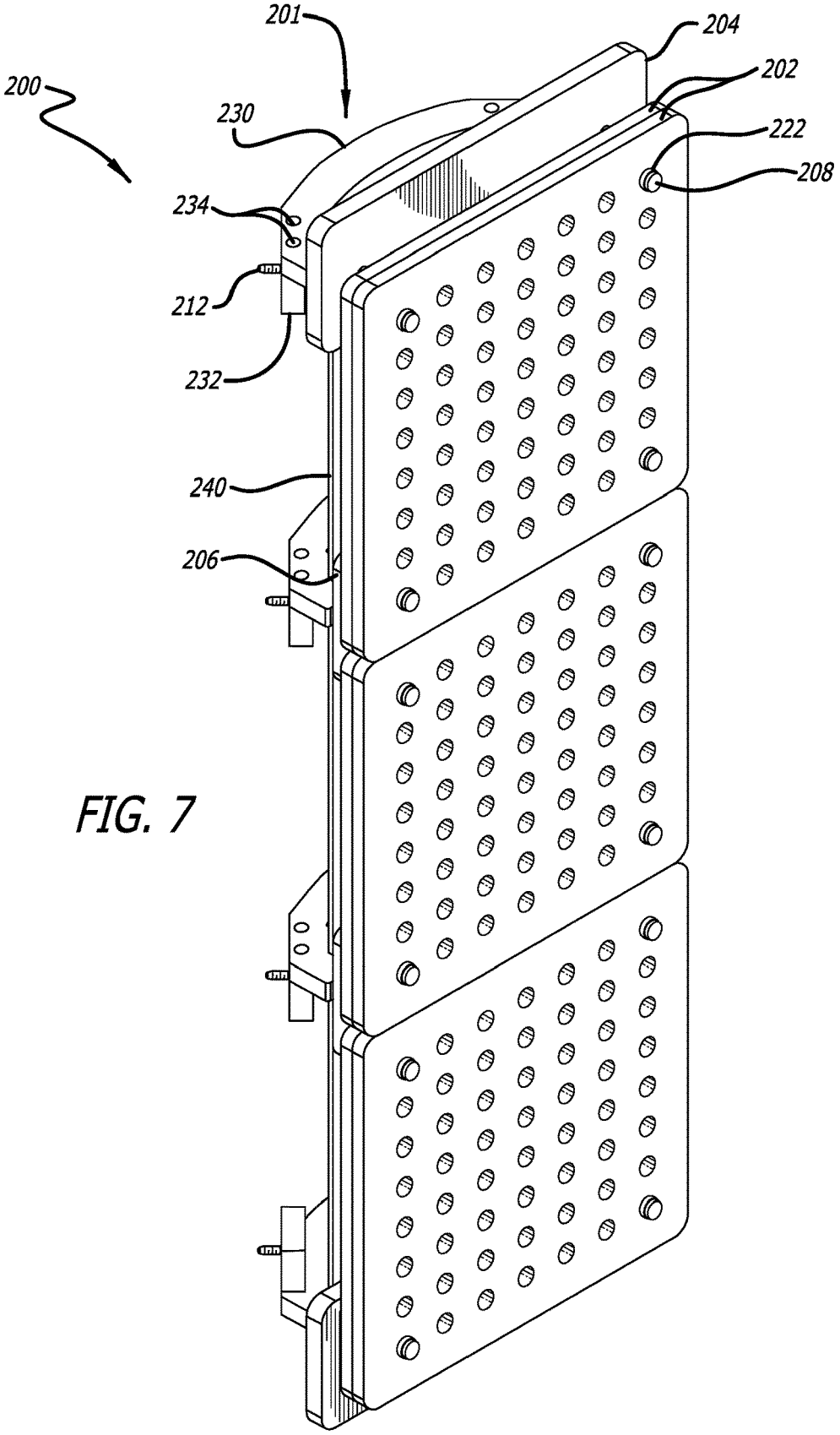
FIG. 7 shows a front perspective view of the corner wall-mounted acoustic deadening device of FIG. 6.
Figure 8:
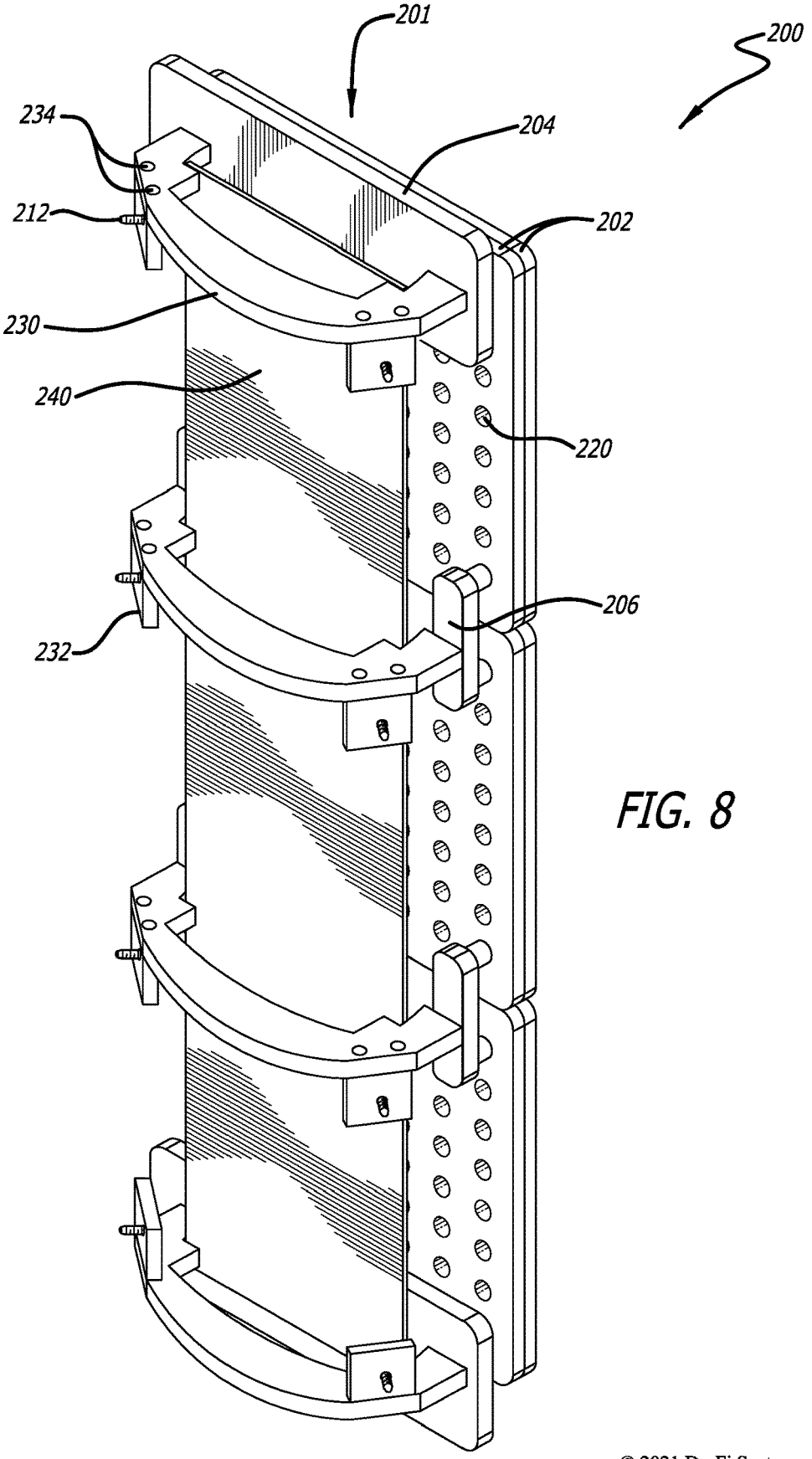
FIG. 8 shows a back perspective view of the corner wall-mounted acoustic deadening device of FIG. 6.
Figure 9:
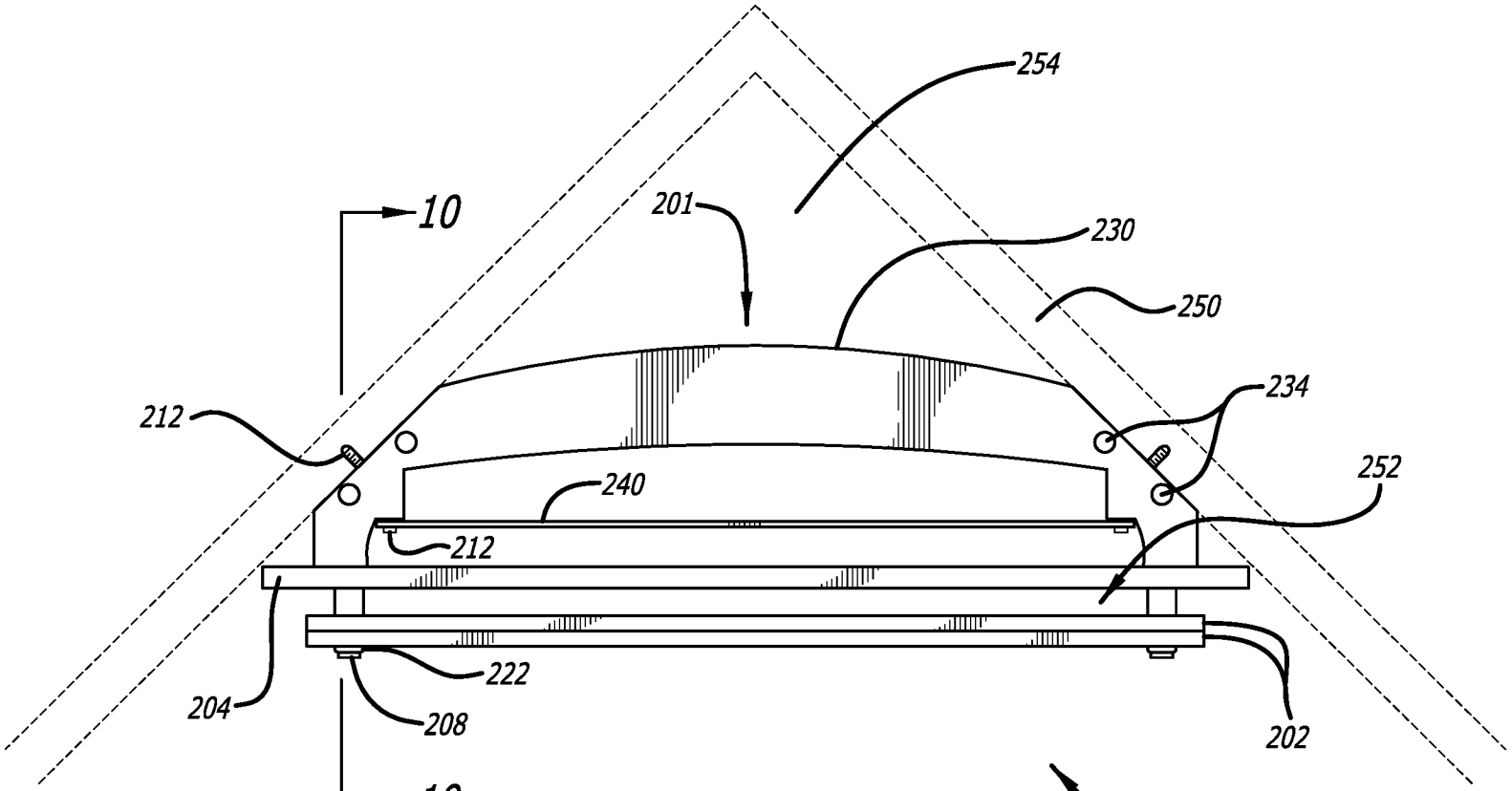
FIG. 9 is a top view of the corner wall-mounted acoustic deadening device of FIG. 6.
Figure 10:
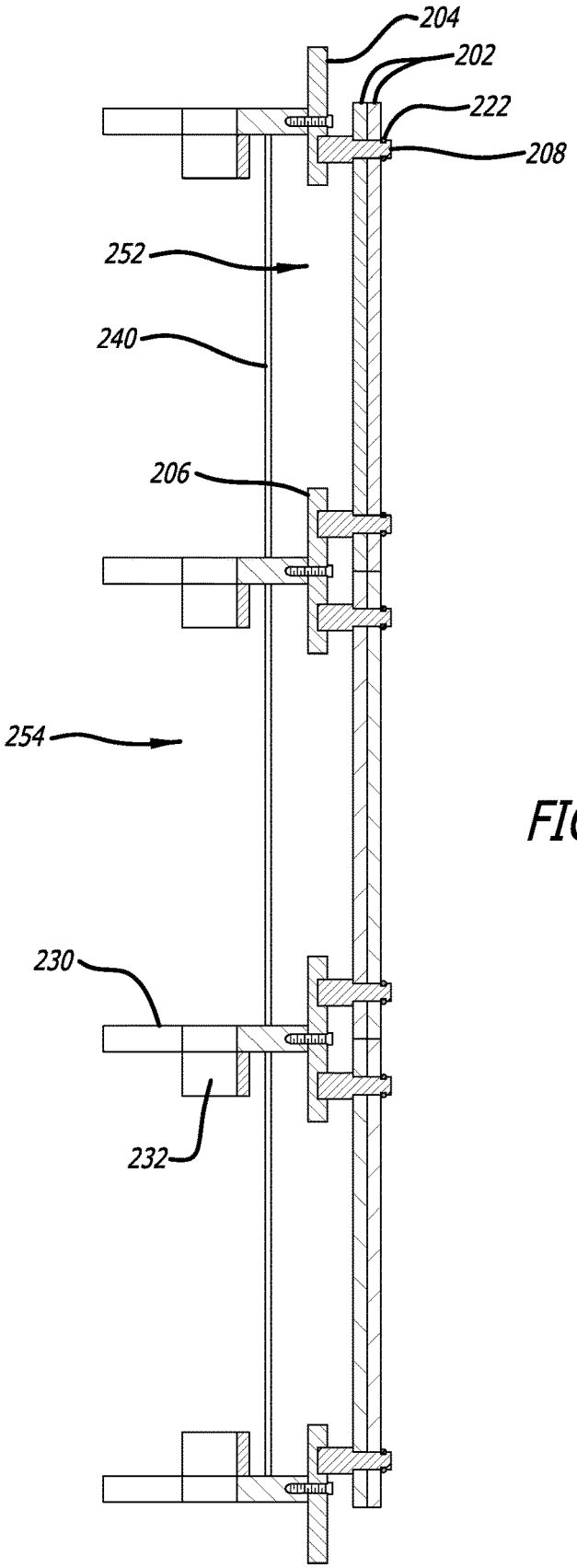
FIG. 10 is a cross-sectional view through plane 10 of FIG. 9 of the corner wall-mounted acoustic deadening device of FIG. 6.

FIGS. 6-10 show the wall-mounted acoustic deadening device of FIGS. 1-5 with additional features that allow the device to be mounted in a corner. In FIGS. 6-10, the two least significant digits are specific to the element, and an element that is not described in conjunction with these figures may be presumed to have the same characteristics and function as the previously described element having the same two least significant digits in FIGS. 1-5.

Panels 202 of corner wall-mounted device 200 are mounted to large mounting plates 204 and small mounting plates 206, as similarly described with respect to FIGS. 1-5. However, the large mounting plates 204 and small mounting plates 206 are not mounted to wall 250. Rather, the large mounting plates 204 and small mounting plates 206 are mounted to the wall 250 via corner mounts 230 attached to blocks 232.

Blocks 232 are mounted the wall 250 with a fastening device 212 (e.g., a nail or a screw) with a first block 232 mounted on one side of the corner of the wall 250 and a second block 232 mounted on the other side of the corner perpendicular to the first block 232. The fastening device 212 can extend through a hole (not shown) in the block 232 into the wall 250, or the block 232 can be mounted to the wall 250 via a bracket or adhesive. The blocks 232 can have any suitable dimensions to support the corner mount 230, e.g., a width, length, and thickness in a range between ½ inch and 5 inches. Further, the blocks can be formed of any suitable material to support the corner mount 230, such as wood, plastic, a composite, or rubber.

The corner mount 230 is then mounted to each of the blocks 232. For example, the corner mount 230 can be positioned such that each end rests on a block 232 and is fixed to that block via fastening devices 212 (e.g., nails or screws) extending through holes 234 in the corner mount 230. Block and corner mounts 230 can be positioned to coordinate with positions of the the large mounting plate 204 and the small mounting plates 206 when the device is assembled.

The corner mounts 230 can be formed of any suitable material, such as wood, plastic, metal or rubber. The corner mounts 230 shown in FIGS. 6-10 are curved. However, the corner mounts 230 can have any suitable configuration, e.g., having one straight section or two sections at an angle to each other. Alternatively, the corner mount 230 and the block 232 can be formed monolithically of one material.

A limp mass 240 can optionally be mounted on the corner mounts 230 between the wall 250 and the panels 202. The corner mounts 230 can have recesses 244 for receiving and mounting the limp mass 240. The limp mass has holes 242 and can be mounted to the corner mount 230 at the recesses 244 by fastening devices 212 (e.g., nails or screws) that extend through the holes 242 into holes 246 in the recess 244. Alternatively, the limp mass 240 can be mounted to the corner mounts 230 via an adhesive. An open space 254 between the wall 250 and the limp mass 240 prevents or reduces the conduction of sound.

The limp mass can be any suitable material to dampen sound, such as rubber, foam, vinyl, or mass loaded vinyl. The limp mass can have any suitable dimensions to coordinate with the device 200. In the device 200 as shown in FIGS. 6-10, the dimensions of the limp mass are slightly smaller than the dimensions of the assembled panels. For example, the limp mass can have a length in a range 12 inches to 64 inches, and a width in a range 12 inches to 64 inches. However, the limp mass 240 can be wider or narrower, or short or longer. A thickness of the limp mass can be in a range from 1 mm to 12 mm.

The limp mass 240 should be placed within a cavity formed by the corner mounts 230 and panels 102. Therein the limp mass 240 can suitably act to deaden particularly bass sounds between frequency 20 Hz and 200 Hz. Although not an entirely perfect metaphor, bass sounds can be analogized to a tennis ball. When surfaces are hard, they ricochet off of those surfaces and reverberate. When the tennis ball is thrown against a blanket hanging from a string, it immediately drops to the ground. Likewise, the limp mass 240 serves to particularly dampen bass frequencies. To accomplish this function, it must hang loosely within the cavity. The corner mounts 230 offer a suitable space into which the limp mass 240 may unobtrusively sit while performing this function.

The large mounting plates 204 and small mounting plates 206 are mounted to the corner mounts 230 distal to the limp mass 240. The large mounting plates 204 and small mounting plates 206 are mounted to the corner mounts 230 via fastening devices 212 (e.g., screws or nails) extending through holes 210 in the mounting plates and into holes 238 in the corner mount 230.

To mount the device 200 to the wall 250, the corner mounts 230 are mounted to the wall 250 at the corner via the blocks 232. The corner mounts 230 are mounted on the wall 250 with suitable orientations with respect to each other such that they coordinate with positions of the large mounting plates 204 and small mounting plates 206 of the device 200. The limp mass 240 is then mounted to corner mounts 230. Next, the mounting plates 204 and 206 are mounted to the corner mounts 230. Both the large mounting plates 204 and the small mounting plates 206 are mounted on the corner mount 230 with suitable orientations with respect to each other such that all of the mounting pegs 208 of each are positioned to engage panel holes 220 of the panels 208. The panels 208 are then mounted on and fixed to the mounting pegs 208. The panels 208 can optionally be fixed to the mounting pegs 208 by positioning the gaskets 222 about the tips of the mounting pegs 208, where the gaskets 222 may or may not be seated in grooves.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A wall-mounted acoustic deadening device comprising:

a mounting device comprising:

at least one mounting plate, each mounting plate comprising a fastener hole and configured to be mounted to a wall; and at least one mounting peg extending horizontally from the at least one mounting plate, each mounting peg having a first portion adjacent the mounting plate with a first diameter and a second portion opposite the mounting plate having a second diameter smaller than the first diameter; and at least two panels, each panel comprising a plurality of panel holes extending through a thickness of the panel, wherein a panel hole diameter is less than the first diameter and greater than or equal to the second diameter, wherein a first panel of the at least two panels is configured to be attached to the mounting device via the at least one mounting peg extending through one of the plurality of panel holes of the first panel and a second panel of the at least two panels is configured to be attached to the mounting device adjacent to the first panel via the at least one mounting peg extending through the one of the plurality of panel holes of the second panel.

2. The device of claim 1, wherein the first and second panels are attached to the mounting device via a friction fit between the at least one mounting peg and the one of the plurality of panel holes of the first panel and the one of the plurality of holes of the second panel.

3. The device of claim 1 further comprising a gasket, wherein the gasket is positioned about the at least one mounting peg opposite the mounting plate to fix the first and second panels to the mounting device.

4. The device of claim 1, wherein the plurality of panel holes of the first panel are aligned with the plurality of panel holes of the second panel.

5. The device of claim 1, wherein two mounting pegs extend horizontally from the at least one mounting plate.

6. The device of claim 5 comprising at least four panels, wherein a first mounting peg extends through the one of the plurality of panel holes of the first panel and the one of the plurality of panel holes of the second panel, and wherein a second mounting peg extends through one of the plurality of holes of a third panel and one of the plurality of holes of a fourth panel.

7. The device of claim 5, wherein a first mounting peg extends through the one of the plurality of panel holes of the first panel and the one of the plurality of panel holes of the second panel, and wherein a second mounting peg extend through another one of the plurality of holes of the first panel and another one of the plurality of holes of the second panel.

8. The device of claim 5 comprising at least four panels, wherein the mounting device comprises at least two mounting plates, wherein a first mounting peg of a first mounting plate extends through the one of the plurality of panel holes of the first panel and the one of the plurality of panel holes of the second panel, wherein a second mounting peg of the first mounting plate extends through a second one of the plurality of holes of the first panel and a second one of the plurality of holes of the second panel, wherein a first mounting peg of a second mounting plate extends through a third one of the plurality of panel holes of the first panel and a third one of the plurality of panel holes of the second panel, and wherein a second mounting peg of the second mounting plate extends through one of the plurality of holes of a third panel and one of the plurality of holes of a fourth panel.

9. The device of claim 1, wherein the at least one mounting peg is formed of wood.

10. The device of claim 1, wherein there is an open space between the wall and the first panel.

11. The device of claim 1, wherein the first panel and the second panel are planar to each other and the wall.

12. The device of claim 1, wherein the mounting device is configured to attach at a corner.

13. The device of claim 12, wherein the mounting device further comprises a corner mount and wherein the at least one mounting plate is mounted to the wall using the corner mount.

14. The device of claim 13, wherein the mounting device further comprises a mounting block, wherein the mounting block is configured to be attached to the wall and the corner mount is attached to the block.

15. The device of claim 12 further comprising a limp mass between the at least two panels and the corner.

16. The device of claim 12 further comprising:

a corner mount, wherein the at least one mounting plate is mounted to the wall via the corner mount; and a limp mass, wherein the limp mass is mounted between the corner mount and the at least one mounting plate.

17. The device of claim 16, wherein there is an open space between the limp mass and the corner.

18. The device of claim 16, wherein the corner mount comprises a recess for receiving the limp mass and the limp mass is mounted to the corner mount within the recess.

19. The device of claim 16, wherein the limp mass is rubber.

20. The device of claim 1 comprising six panels.

* * * * *